United States Patent [19]

Palau et al.

[11] Patent Number: 4,682,634

[45] Date of Patent: Jul. 28, 1987

[54] LIFTING BEAM FOR SHED FORMING DEVICE IN A WEAVING LOOM

[76] Inventors: Joseph Palau, Les Perris, FR-74410 Dungt; Dario Bassi, 44 Rue des Treilles, FR69960 Corbas, both of France

[21] Appl. No.: 896,268

[22] Filed: Aug. 14, 1986

[30] Foreign Application Priority Data

Aug. 23, 1985 [FR] France ..... 85 12818

[51] Int. Cl.[4] ..... D03C 13/00

[52] U.S. Cl. ..... 139/85; 254/394

[58] Field of Search ..... 139/82, 83, 84, 85, 139/87, 88, 449; 254/394

[56] References Cited

U.S. PATENT DOCUMENTS

| | | | |
|---|---|---|---|
| 3,115,900 | 12/1963 | Egli | 139/85 |
| 3,871,417 | 3/1975 | Filter | 139/88 |
| 4,041,991 | 8/1977 | Dewas | 139/449 |
| 4,154,428 | 5/1979 | Merry | 254/394 |

*Primary Examiner*—Henry S. Jaudon

*Attorney, Agent, or Firm*—Dowell & Dowell

[57] ABSTRACT

A lifting beam for the shed forming device in a weaving loom which includes a fork joint made in the form of two cheeks or pairs of opposing flanges having aligned openings formed therein through which the stub shaft of two pulleys are rotatably mounted. The pulleys are made of an appropriate plastic material which is over-molded over the metal pins or shafts with opposing grooves provided in the interfaces of the cheeks to facilitate positioning of the pins in the openings.

10 Claims, 6 Drawing Figures

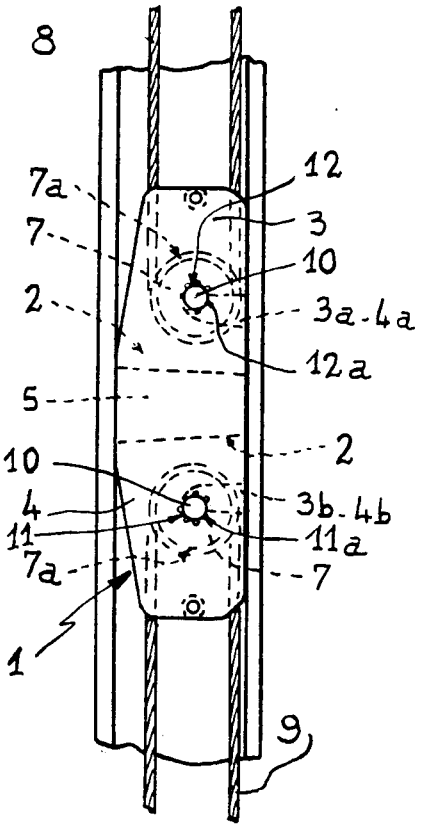
Fig. 1
Fig. 2
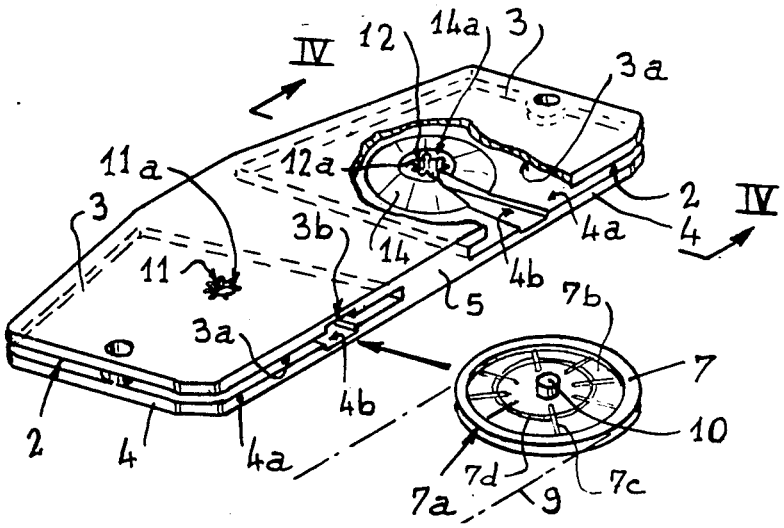

LIFTING BEAM FOR SHED FORMING DEVICE IN A WEAVING LOOM

BACKGROUND OF THE INVENTION

The present invention relates to a lifting beam for the shed forming device in a weaving loom.

HISTORY OF THE ART

Certain shed forming devices in a weaving loom are known to comprise two mobile hooks which are lifted and lowered alternately and of which the funicular connection passes around an idle pulley mounted between the two cheeks of a fork joint which comprises another idle pulley mounted in tandem, and around which the harness cord passes. The assembly composed of the fork joint and the two pulleys is called a lifting beam in the art.

It will be readily understood that, in high-speed weaving looms for making fancy fabrics, the warp yarns are very often lifted and lowered to allow the passage of the shuttle placing a pick in the shed. In known lifting beams, the pivot pins of the two idle pulleys are fixed with respect to the cheeks of the fork joint so that wear occurs at the level of the bores or openings of the pulleys. The latter openings become oval in time, this bringing about a variation in the initial adjustment of the shed forming device. Such variations may lead to weaving problems which the present invention aims at obviating.

SUMMARY OF THE INVENTION

To this end, each idle pulley of the lifting beam according to the present invention is secured to a pivot pin or stub shaft which is fixed with respect thereto and which rotates in openings made in the cheeks of the fork joint, which openings therefore constitute a bearing for the rotation of the pins or stub shafts.

According to one embodiment, the pulleys are made of an appropriate plastics material such as nylon and are overmoulded on a metal pin.

The fork joint of the lifting beam is preferably made in the form of two cheeks moulded in one piece from semi-rigid plastic material. The inner faces of these cheeks includes opposite grooves which facilitates the guiding of the ends of each pin or stub shaft to engage them by slightly separating said the cheeks in the bores or openings in which they rotate.

BRIEF DESCRIPTION OF THE DRAWINGS

The invention will be more readily understood on reading the following description with reference to the accompanying drawings, in which:

FIG. 1 is a view of a lifting beam according to the invention which is disposed in a slideway which guides its vertical reciprocating movement.

FIG. 2 is an exploded partial assembly view with portions broken away showing the fork joint of the lifting beam and one of its pulleys before assembly thereof.

DESCRIPTION OF THE PREFERRED EMBODIMENT

Figure 3:
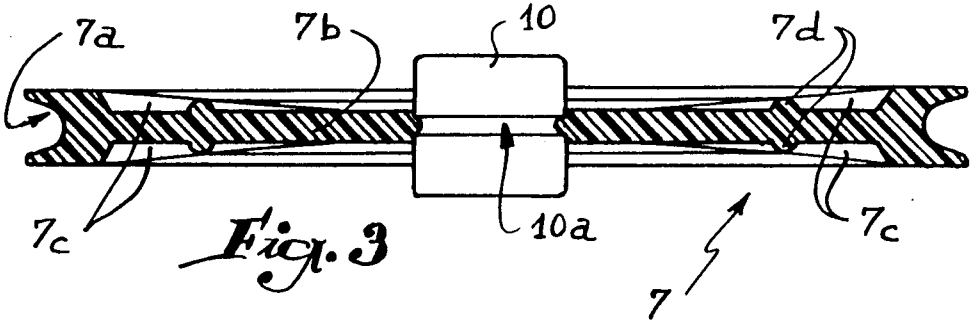
FIG. 3 is an enlarged cross section through one of the pulleys of the lifting beam of FIG. 1.

Referring now to the drawings, FIGS. 1 and 2 illustrate a lifting beam 1 according to the invention, comprising a fork joint 2 made in the form of two cheeks or opposing flanges 3 and 4 joined by a central transverse web 5 so that the fork joint is in the form of a double T of which the web is represented by web having the cheeks or opposing flanges extending outwardly therefrom.

The lifting beam 1 further comprises two pulleys 7 around one of which passes a cord 8 of which the two ends are fastened to hooks so as to be moved by vertical reciprocating movements of the cord, while the other pulley is associated with a harness cord 9 of which one end is fixed and the other is connected to a heddle (not shown) cooperating with a warp yarn, as is well known. Each pulley is, as illustrated in FIG. 3, made of an appropriate semi-rigid plastics material such as a super polyamide or the like, suitably overmoulded on a metal pin 10 (FIG. 3). The periphery of each pulley 7 comprises a semi-circular groove 7*a* which receives either the cord 8 or the harness cord 9. Each pulley also includes an annular web 7*b* and radial and annular reinforcing flanges 7*c* and 7*d*. Pin 10 is provided with a median groove 10*a* in which the structural matter of the pulley 7 is anchored, so that the latter and the pin are joined angularly and transversely.

The cheeks 3 and 4 of the fork joint are further provided with two bores or openings 11 and 12 adapted to receive the pin 10 of each of the pulleys 7.

Figure 4:
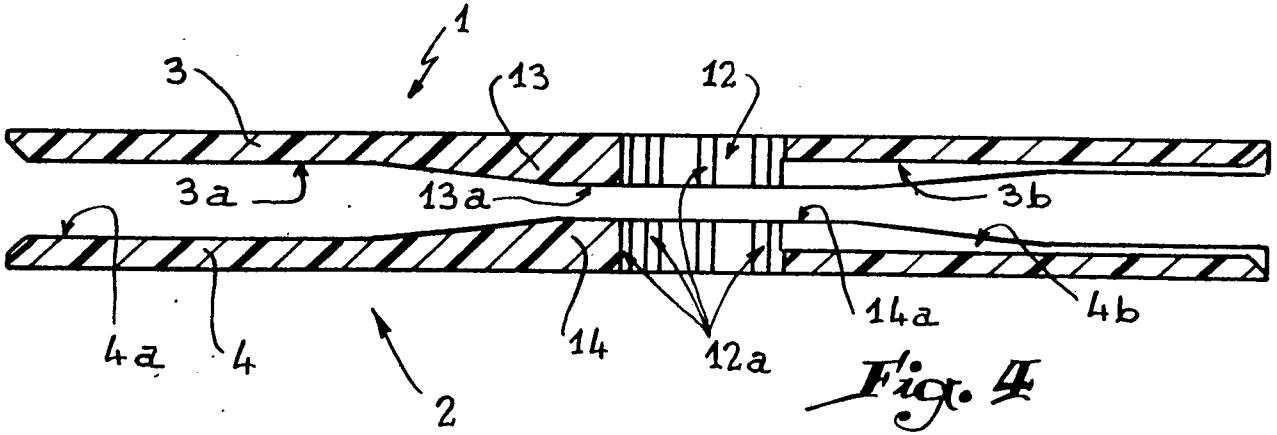
FIG. 4 is an enlarged exploded cross sectional view of the fork joint of the lifting beam taken along line IV—IV (FIG. 2).

About adjacent each of these bores or openings 11, 12, the opposite inner faces 3*a*, 4*a* of each cheek 3, 4 of the fork joint 2 each include a boss 13, 14 respectively (FIG. 4) which are generally truncated in shape and which present a central face 13*a*, 14*a* against which each wall of the annular web 7*b* of the corresponding pulley rests.

Figure 5:
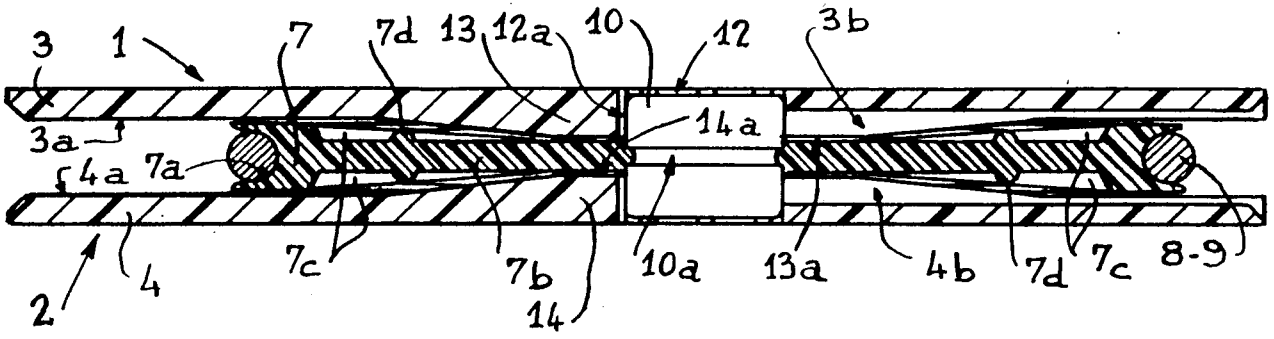
FIG. 5 is an enlarged cross sectional view of the lifting beam taken along lines IV—IV of FIG. 2 in the assembled state.

For positioning each pulley, the inner faces 3*a* and 4*a* of the cheeks or opposing flanges 3 and 4 and the bosses 13, 14 include two opposite grooves 3*b*, 4*b* which extend from one of the edges of the fork joint and which end at the bores or openings 11, 12. To effect positioning of each pulley, the cheeks 3 and 4 are slightly separated so that the ends of the pin 10 may engage in the slideway formed by the two grooves 3*b*, 4*b*, then the pulley is pushed inwardly in this slideway until the ends of the pin 10 clip elastically in the bores openings 11 and 12, so that the pin comes into the position illustrated in FIG. 5, i.e. free to rotate between the two bosses 13, 14 of the two cheeks with lateral clearance tolerance.

It is observed that the walls of bores or openings 11 and 12 are provided with transverse grooves 11*a*, 12*a* extending radially in centrifugal manner and function to collect any impurities that may be found between the pin and these bores. The impurities are then stored in grooves 11*a*, 12*a* without their coming into contact with the pin 10 and damaging it.

Figure 6:
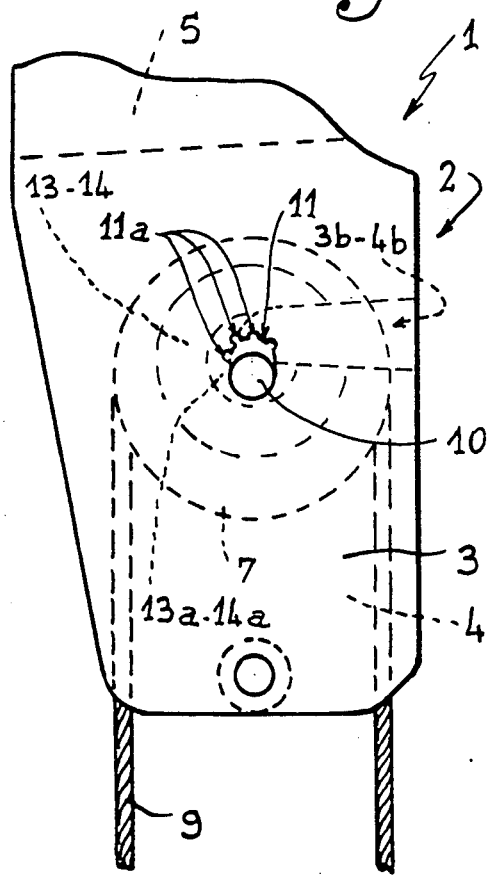
FIG. 6 shows a detailed enlarged view having portions broken away, of a cheek of a lifting beam according to the invention after wear of the bore or opening in which the pin of a pulley rotates.

After long use under the efforts applied to the lifting beam in the longitudinal direction, bores 11 and 12 wear out and become oblong, as illustrated in FIG. 6, so that correct geometry of the seat of rotation of the pins or stub shafts which moves without varying in shape is thus preserved. Therefore, once the bores 11 and 12 become elongated or oval in configuration, the grooves 11*a*, 12*a* disappear at the level of the seat of rotation, and have no more usefulness elsewhere.

It must, moreover, be understood that the foregoing description has been given only by way of example and that it in no way limits the domain of the invention which would not be exceeded by replacing the details of execution described by any other equivalents. In particular, the two cheeks or opposing pairs of flanges 3, 4 of the fork joint 2 may be made in the form of two suitably assembled separate parts.

What is claimed is:

1. A lifting beam apparatus for the shed forming device in a weaving loom comprising a fork joint having oppositely oriented cheeks, openings through each of said cheeks, a pair of pulley means and having a web portion mounted to a central pivot pin means, said openings providing bearing means for selectively receiving one of said pivot pin means of said pulley means therein so that said pulley means are rotatably mounted in spaced relationship within said oppositely oriented cheeks, said cheeks having inner surfaces, said openings being surrounded on said inner surfaces of each cheek with a truncated boss having a central face which is co-axial with said openings, said web portion of each of said pulleys resting against said central face.

2. The lifting beam of claim 1 wherein each pulley is formed of a plastic material which is molded about said pivot pin means.

3. The lifting beam of claim 2 in which said inner faces of each of said cheeks includes opposing grooves which extend from said openings outwardly of said cheeks, said pivot pin means of each of said pulley means being slidably movable along said opposing grooves so as to separate said cheeks to permit said pivot means to be seated within said openings, and said fork joint and said cheeks being integrally molded from semi-rigid plastic material.

4. The lifting beam of claim 3 in which said openings are defined by side walls having radial grooves therein and which extend substantially entirely around said openings.

5. A lifting beam apparatus for the shed forming device in a weaving loom comprising a fork joint having oppositely oriented cheeks, openings through each of said cheeks, a pair of pulley means and having a web portion mounted to a central pivot pin means, said openings providing bearing means for selectively receiving one of said pivot pin means of said pulley means therein so that said pulley means are rotatably mounted in spaced relationship within said oppositely oriented cheeks, said cheeks having inner surfaces, said inner faces of each of said cheeks include opposing grooves which extend from said openings outwardly of said cheeks, said pivot pin means of each said pulley means being slidably movable along said opposing grooves so as to separate said cheeks to permit said pivot means to be seated within said openings, and said fork joint and said cheeks being integrally molded from semi-rigid plastic material.

6. The lifting beam of claim 5 in which said openings are defined by side walls having radial grooves therein and which extend substantially entirely around said openings.

7. The lifting beam of claim 6 in which each of said pulley means is molded about said pivot pin means.

8. The lifting beam apparatus for the shed forming device in a weaving loom comprising a fork joint having oppositely oriented cheeks, openings through each of said cheeks, a pair of pulley means and having a web portion mounted to a central pivot pin means, said openings providing bearing means for selectively receiving one of said pivot pin means of said pulley means therein so that said pulley means are rotatably mounted in spaced relationship within said oppositely oriented cheeks, said cheeks having inner surfaces, said openings being defined by side walls having radial grooves therein and which extend substantially entirely around said openings.

9. The lifting beam of claim 8 in which said openings are surrounded on said inner surfaces of each cheek with a truncated bore having a central face which is co-axial with said openings, said web portion of each of said pulleys resting against said central face.

10. The lifting beam of claim 9 in which said inner faces of each of said cheeks include opposing grooves which extend from said openings outwardly of said cheeks, said pivot pin means of each of said pulley means being slidably movable along said opposing grooves so as to separate said cheeks to permit said pivot means to be seated within said openings, and said fork joint and said cheeks being integrally molded from semi-rigid plastic material.

* * * * *